US010349801B2

(12) United States Patent
Zhu et al.

(10) Patent No.: US 10,349,801 B2
(45) Date of Patent: Jul. 16, 2019

(54) DOUBLE-SIDED MOP

(71) Applicant: Jiaxing Jackson Travel Products Co., Ltd., Jiaxing, Zhejiang (CN)

(72) Inventors: Xue Lin Zhu, Jiaxing (CN); Jiu Hong Zhang, Jiaxing (CN); Kai Feng Lu, Jiaxing (CN)

(73) Assignee: JIAXING JACKSON TRAVEL PRODUCTS CO., LTD., Zhejiang (CN)

( * ) Notice: Subject to any disclaimer, the term of this patent is extended or adjusted under 35 U.S.C. 154(b) by 327 days.

(21) Appl. No.: 15/275,940

(22) Filed: Sep. 26, 2016

(65) Prior Publication Data

US 2017/0086637 A1 Mar. 30, 2017

(30) Foreign Application Priority Data

Sep. 28, 2015 (CN) ..... 2015 2 0756804 U

(51) Int. Cl.

| | |
|---|---|
| ***A47L 25/00*** | (2006.01) |
| ***A47L 13/258*** | (2006.01) |
| ***A47L 13/14*** | (2006.01) |
| ***B25G 1/06*** | (2006.01) |
| ***B25G 3/38*** | (2006.01) |

(52) U.S. Cl.

CPC ..... *A47L 13/258* (2013.01); *A47L 13/14* (2013.01); *B25G 1/06* (2013.01); *B25G 3/38* (2013.01)

(58) Field of Classification Search

USPC ..... 15/228, 147.1, 147.2, 229.8, 231

See application file for complete search history.

(56) References Cited

U.S. PATENT DOCUMENTS

| | | | | |
|---|---|---|---|---|
| 9,943,207 | B1 * | 4/2018 | Patterson | A47L 13/258 |
| 2002/0152569 | A1 * | 10/2002 | Zorzo | A47L 13/258 15/147.1 |
| 2012/0073074 | A1 * | 3/2012 | Hsu | A47L 13/256 15/228 |

* cited by examiner

*Primary Examiner* — Joseph J Hail
*Assistant Examiner* — Shantese L McDonald
(74) *Attorney, Agent, or Firm* — Muncy, Geissler, Olds & Lowe, P.C.

(57) ABSTRACT

A double-sided mop according to this invention, being provided to solve the problems of a conventional mop on poor floor mopping quality, includes a mop pole, a mop head connecting to the mop pole, and a cleaning cloth provided on the surface of mop head. The mop head includes a mounting plate, a first panel, a second panel, a hinged shaft, a universal joint, and an elastic part, in which the mounting plate is provided between the first panel and the second panel, the mounting plate is hinged and connects to the hinged shaft together with the first panel and the second panel, the elastic part applies a force to clamp the first panel and the second panel, the universal joint is installed on the mounting plate by rotation, and the mop pole connects to the universal joint.

11 Claims, 13 Drawing Sheets

DOUBLE-SIDED MOP

FIELD OF THE INVENTION

This invention relates to a cleaning tool, particularly to a double-sided mop.

BACKGROUND OF THE INVENTION

A flat mop is a mop of which the head is flat so that it may completely contact the ground surface and even may go deep into dead areas of a sofa, furniture and the like. Currently, the flat mop comprises a mop head and a mop pole. The mop head comprises a panel on which a cloth is installed. To increasingly make the mop become more effective, a double-sided mop is currently implemented. The panel of the mop head of the double-sided mop has two sides on which the pieces of cloth are installed, respectively, and the mop pole is hinged between the two pieces of cloth. To make the mop pole freely rotate up and down relative to the mop head, a corresponding slot must be formed on the panel and each of the pieces of cloth, thereby making the mop pole smoothly pass through the slots. However, the slots being formed on the panel and each of the pieces of cloth, the area of slot is hollow, which brings poor effect on floor mopping due to the slots that offers effective cleaning. Further, the panel applies a weak force to the floor, which affects the quality of cleaning.

Consequently, because of the technical defects described above, to provide the rotary valve improver, the applicant, based on many years of research and experience in the relevant industry, has developed the present invention, which may effectively improve the defects described above.

SUMMARY OF THE INVENTION

To solve the technical problems described above, this invention is mainly to provide a mop which is designed rationally, gives high quality of floor mopping, and offers flexible operation.

To achieve the above object, this invention provides a double-sided mop comprising a mop pole, a mop head connecting to the mop pole, and a cleaning cloth provided on the surface of mop head. The mop head comprises a first panel, a mounting plate corresponding to the first panel, a second panel that is corresponding to the first panel so as to clamp the mounting plate together with the first panel, a hinged shaft connecting to the first panel, the mounting plate, and the second panel, an elastic part connecting to the first panel and the second panel so as to make the first panel and the second panel to be normally folded or unfolded toward the mounting plate, and a universal joint that is provided on the mounting plate and connects to the mop pole and thus may run in a rotation travel so as to make the mop head rotate with respect to the mop pole. With the universal joint, the mop pole may be made to rotate all around. When the mop pole rotates tangentially around the hinged shaft, the mop pole that runs in the direction of rotation forces the first and second panels to rotate around the hinged shaft, thereby, thanks to the simplified structure and simple usage, making the mop pole freely rotate tangentially around the hinged shaft and there being no need of any slot on the first and second panels, optionally through which the mop pole passes in the stress direction. Accordingly, when the first panel or the second panel applies a force to the floor, the floor may be evenly stressed, thereby the effect of cleaning being increased.

In an embodiment, the universal joint comprises a damper hinged onto the mounting plate, and a rotation shaft that is provided on the damper and is provided for connection to the mop pole. Accordingly, the mop pole may be made to rotate around the rotation shaft. Further, the rotation shaft is vertical to the hinged shaft so that, thanks to the features of simplified structure, reasonable design, and flexible operation, the mop pole may rotate all around with respect to the mop head.

In an embodiment, the mop head comprises a connecting rod. One end of the connecting rod connects to the mop pole, while the other end passes through the first panel and the second panel to connect to the universal joint.

In an embodiment, the elastic part is a torsional spring. The torsional spring comprises a body, a first arm that stretches from the body and is provided on the first panel to apply a force to the first panel, and a second arm that stretches from the body and is provided on the second panel to apply a force to the second panel. With the torsional spring, the first panel and the second panel are made to move normally toward the mounting plate and tightly clamp the mounting plate. During floor mopping, the mop pole is stressed, the first panel and the second panel are brought to the floor by the mop pole that is working and, on the other hand, flips in a direction in which the connecting rod is stressed through the hinged shaft that moves away from the floor. When the force applied to the mop pole is removed, the first panel and the second panel return to the clamping state when the torsional spring works.

In an embodiment, the double-sided mop comprises a water-squeezing frame. The water-squeezing frame comprises a sleeve set around the mop pole, and a water-squeezing portion fixed onto the sleeve. The water-squeezing frame formed a travel movement with respect to the mop pole that glides. In the travel movement, the water-squeezing portion glides with respect to the cleaning cloth to squeeze water out of the cleaning cloth.

In an embodiment, the double-sided mop further comprises a counterweight block that is fixed onto the mop head and is arranged at a side of a connection where the connecting rod connects to the universal joint. With the counterweight block, when the mop is lifted relatively from the floor, the mop head automatically rotates and stops until it aligns with the mop pole, thereby facilitating water squeezing from the mop head.

In an embodiment, the counterweight block is provided on the mounting plate and kept away from the side of connection where the connecting rod connects to the universal joint.

Compared with the conventional technology, the technology of this invention has the advantages of simplified structure and reasonable design. Further, with the universal joint, the mop pole may be made to rotate all around. When the mop pole rotates tangentially around the hinged shaft, the connecting rod forces the first and second panels to rotate around the hinged shaft, thereby making the mop pole freely rotate tangentially around the hinged shaft. There is no need of any slot on the first and second panels for the connecting rod that is working. Accordingly, when the first panel or the second panel applies a force to the floor, the floor may be evenly stressed, thereby the effect of cleaning being increased.

The foregoing objectives and summary provide only a brief introduction to the present invention. Other objects, features, and advantages of the present invention will become conspicuous to those skilled in the art upon reading the following detailed descriptions accompanying by the illustrations.

DETAILED DESCRIPTION OF THE PREFERRED EMBODIMENTS

Figure 1:
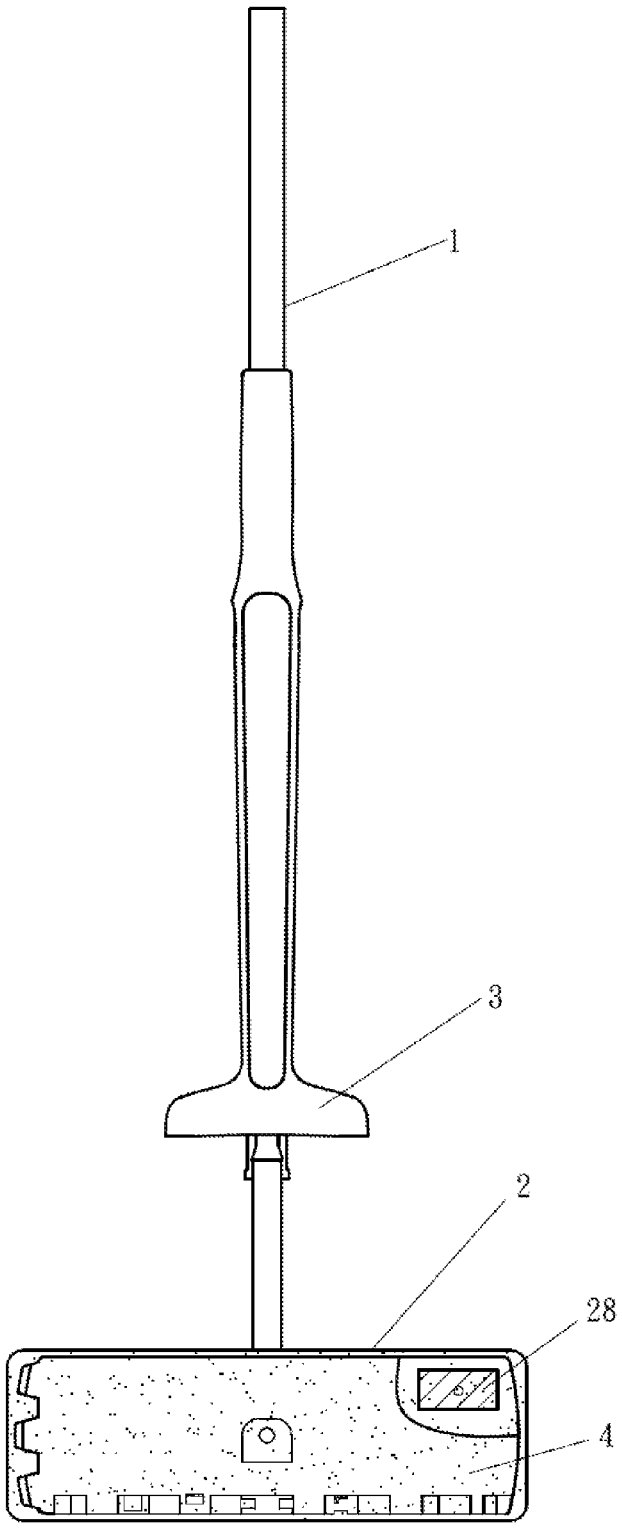
FIG. 1 is a schematic view illustrating the structure of a double-sided mop in an embodiment of this invention.
Figure 2:
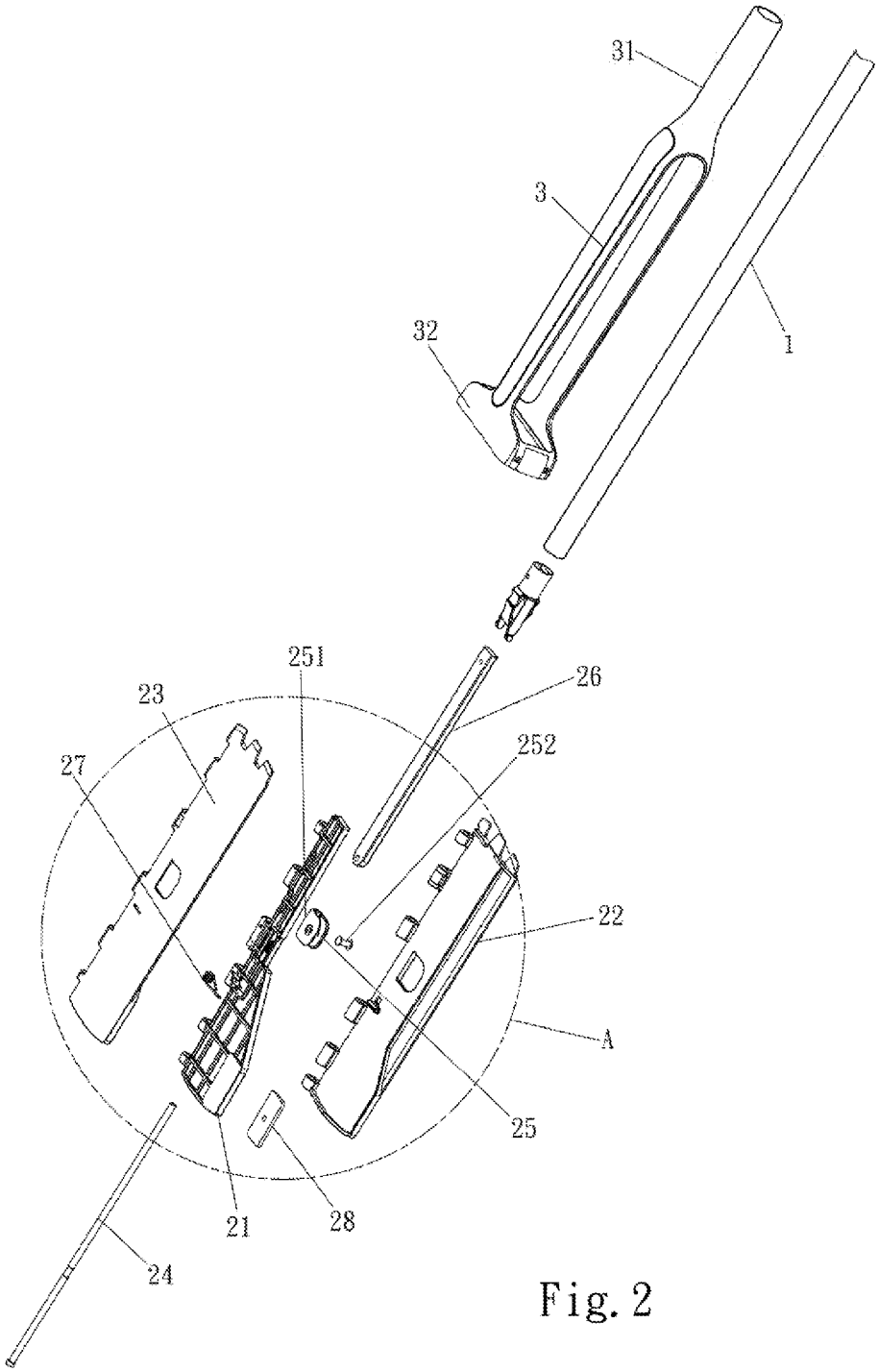
FIG. 2 is an exploded view of the double-sided mop in an embodiment of this invention.
Figure 3:
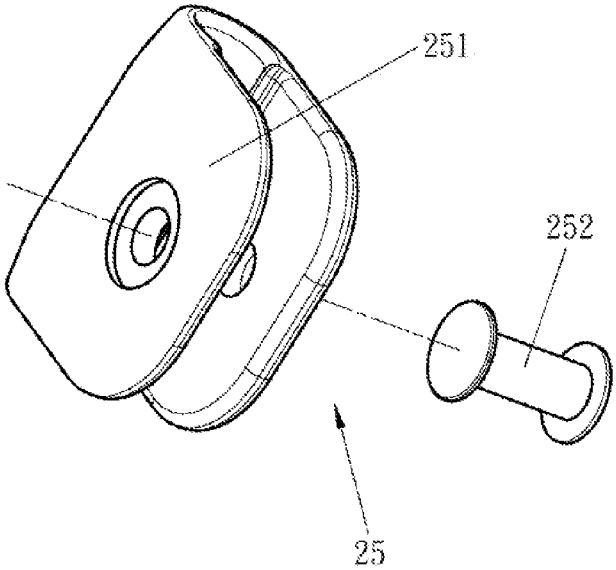
FIG. 3 is an exploded view of a universal joint in an embodiment of this invention.
Figure 4:
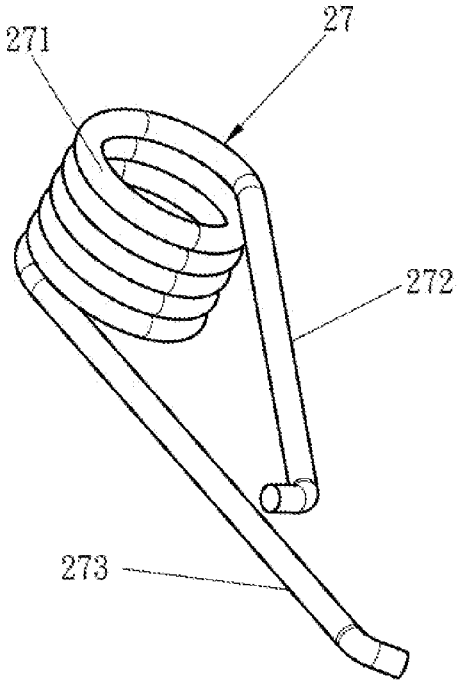
FIG. 4 is a schematic view illustrating the structure of an elastic part in an embodiment of this invention.
Figure 5:
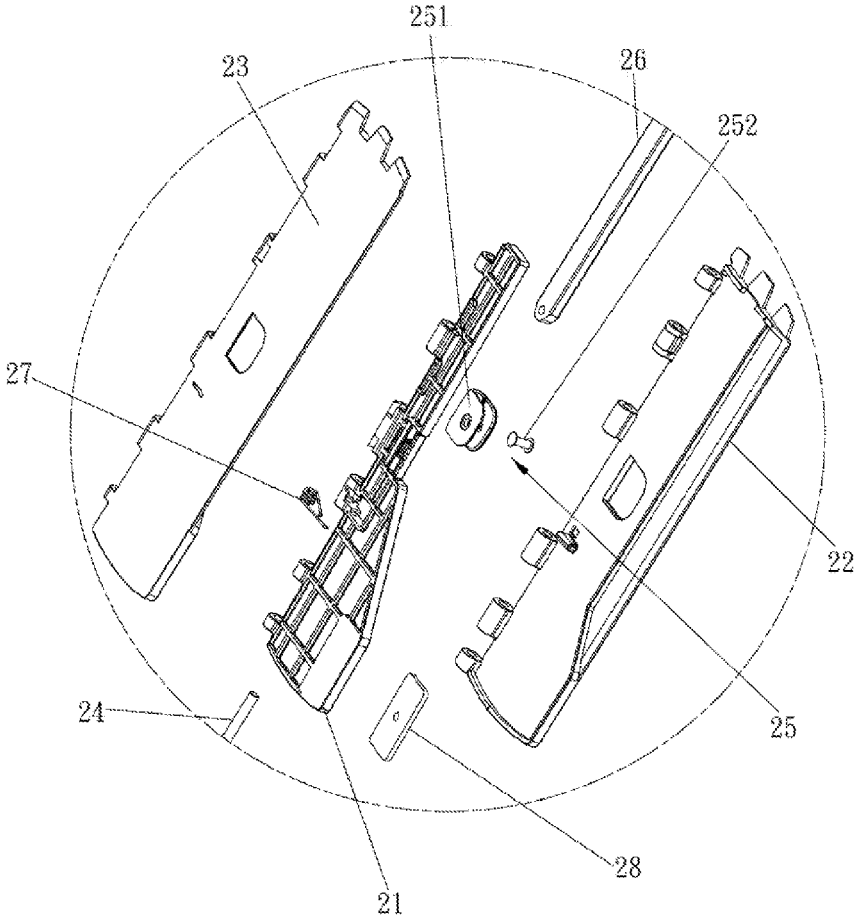
FIG. 5 is an enlarged view of section A of the structure in FIG. 1.
Figure 6:
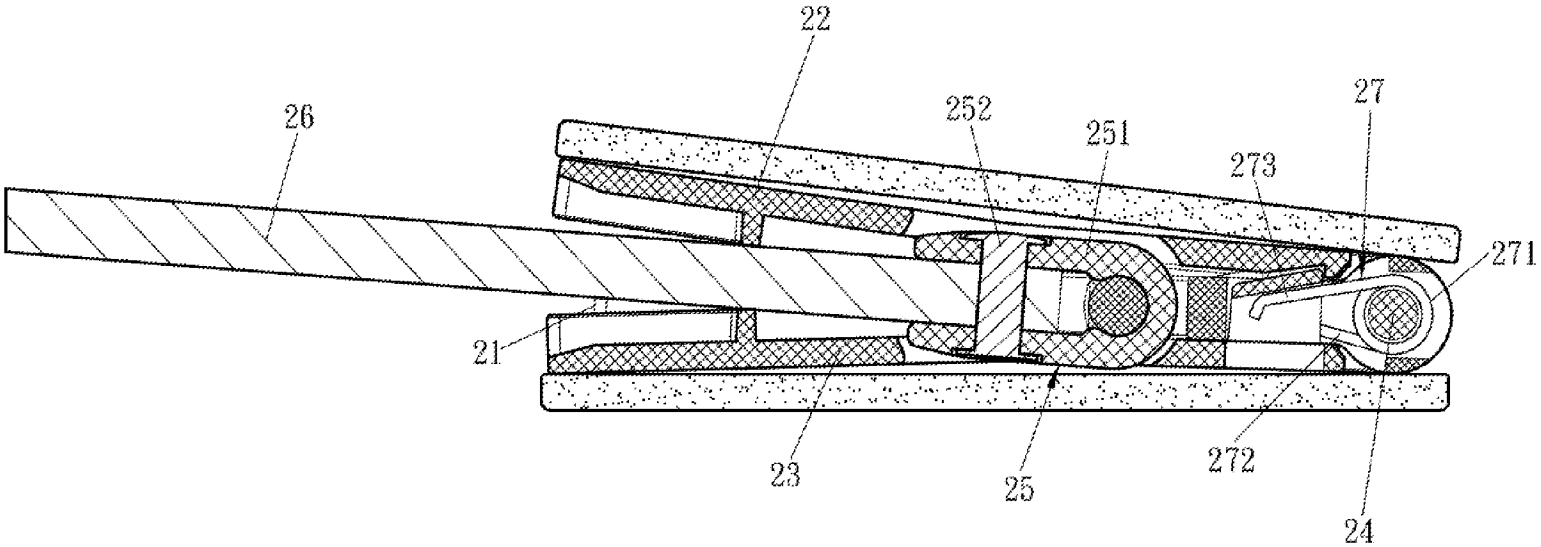
FIG. 6 is a sectional view of the structure of a mop head in an embodiment of this invention.

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

With reference to FIG. 1 through FIG. 8E, a double-sided mop according to this invention comprises a mop pole 1, a mop head 2, a water-squeezing frame 3, and a cleaning cloth 4.

In an embodiment, the cleaning cloth 4 is provided on the surface of the mop head 2. The mop head 2 comprises a first panel 22, a mounting plate 21 corresponding to the first panel 22, a second panel 23 that is corresponding to the first panel 22 so as to clamp the mounting plate 21 together with the first panel 22, a hinged shaft 24 connecting to the first panel 22, the mounting plate 21, and the second panel 23, an elastic part connecting to the first panel 22 and the second panel 23 so as to make the first panel 22 and the second panel 23 to be normally folded or unfolded toward the mounting plate 21, and a universal joint 25 that is provided on the mounting plate 21 and connects to the mop pole 1 and thus may run in a rotation travel so as to make the mop head 2 rotate with respect to the mop pole 1. Further, the mop head 2 comprises a connecting rod 26.

With the universal joint 25, the mop pole 1 may be made to rotate all around. When the mop pole 1 rotates tangentially around the hinged shaft 24, the connecting rod 26 forces the first panel 22 or the second panel 23 to rotate around the hinged shaft 24, thereby, thanks to the simplified structure and simple usage, making the mop pole 1 freely rotate tangentially around the hinged shaft 24. Besides, there is no need of any slot on the first panel 22 and the second panel 23 for the connecting rod 26 that is working to pass through. Accordingly, when the first panel 22 or the second panel 23 applies a force to the floor, the floor may be evenly stressed, thereby the effect of cleaning being increased.

Figure 7A:
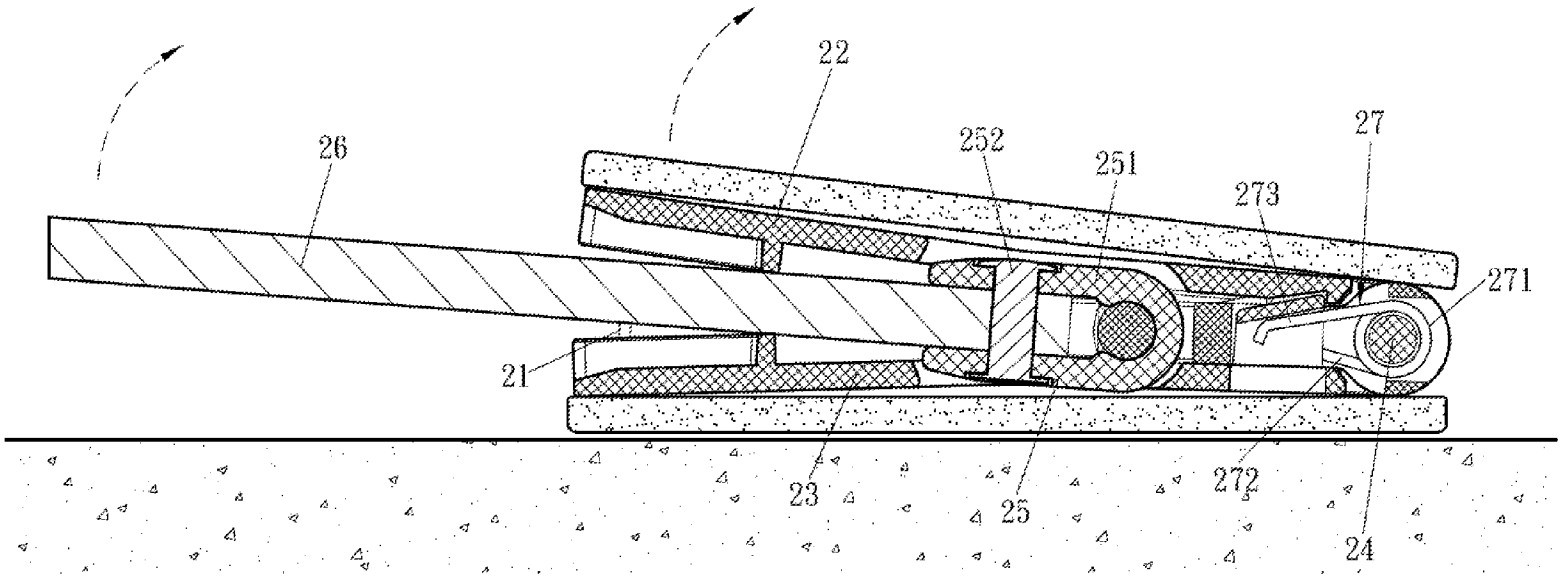
FIG. 7A through FIG. 7C are schematic views illustrating a continuous operation state of the mop head in an embodiment of this invention in which a connecting rod is working frontward and backward.
Figure 7B:
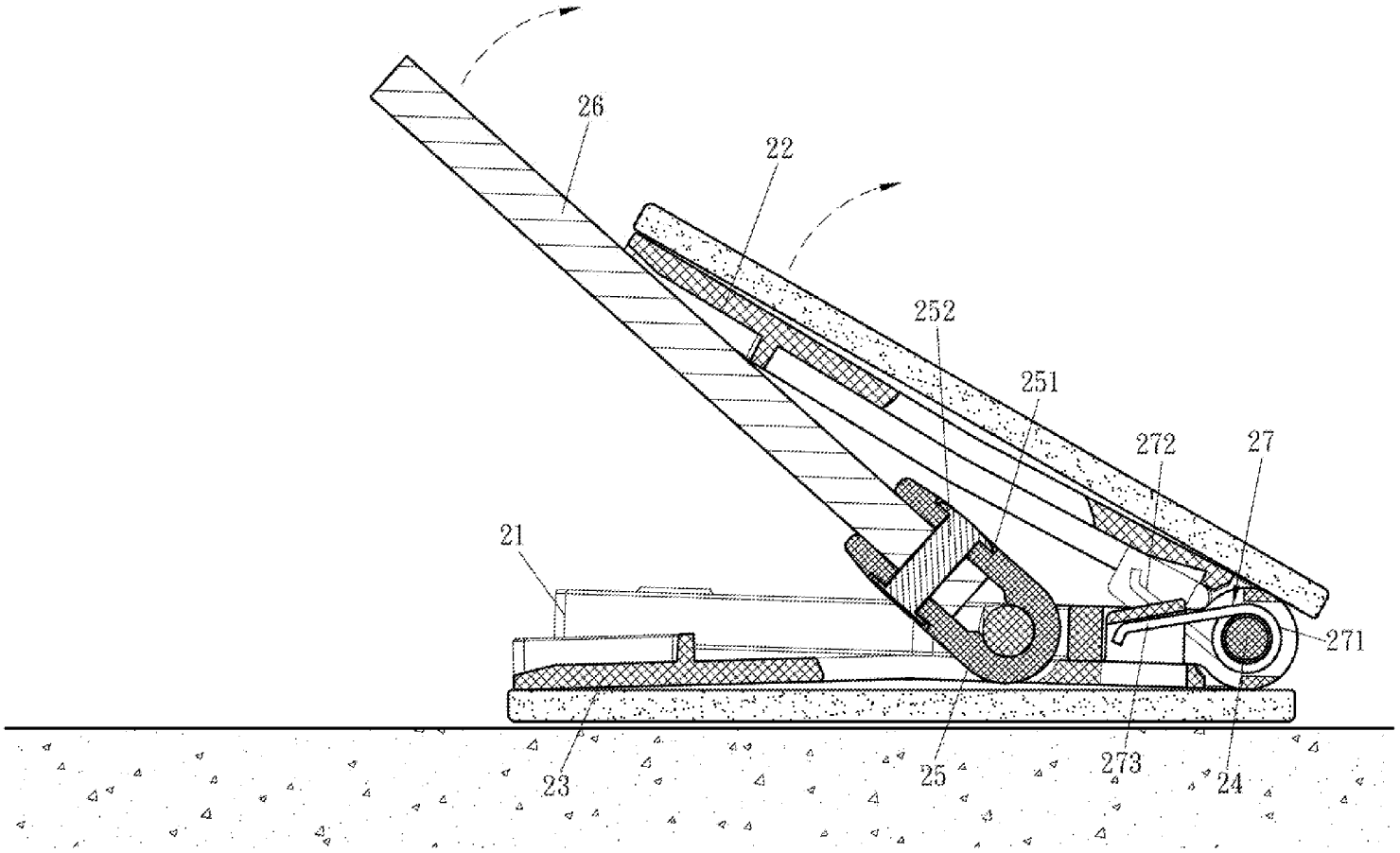
Figure 7C:
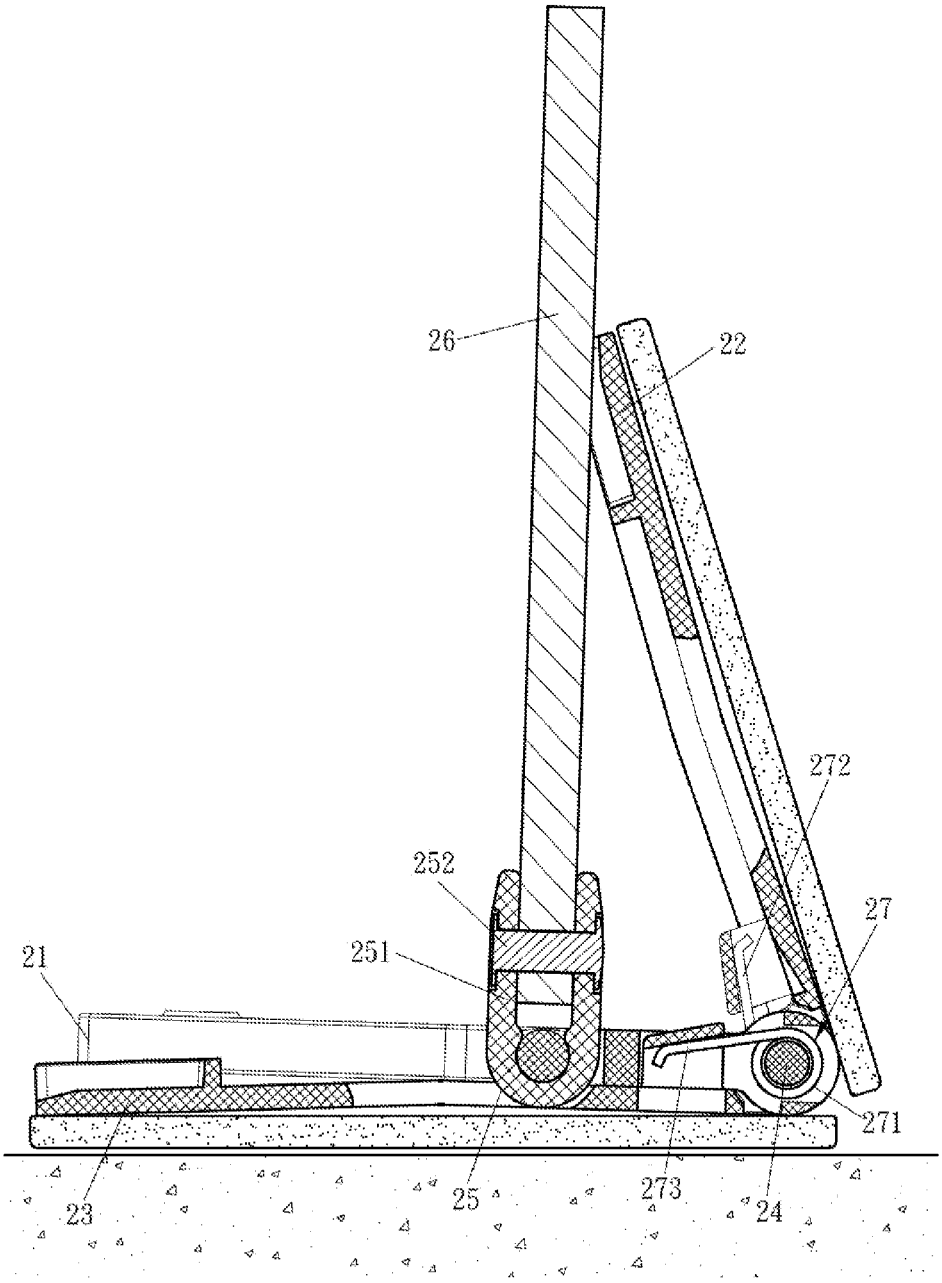
Figure 8A:
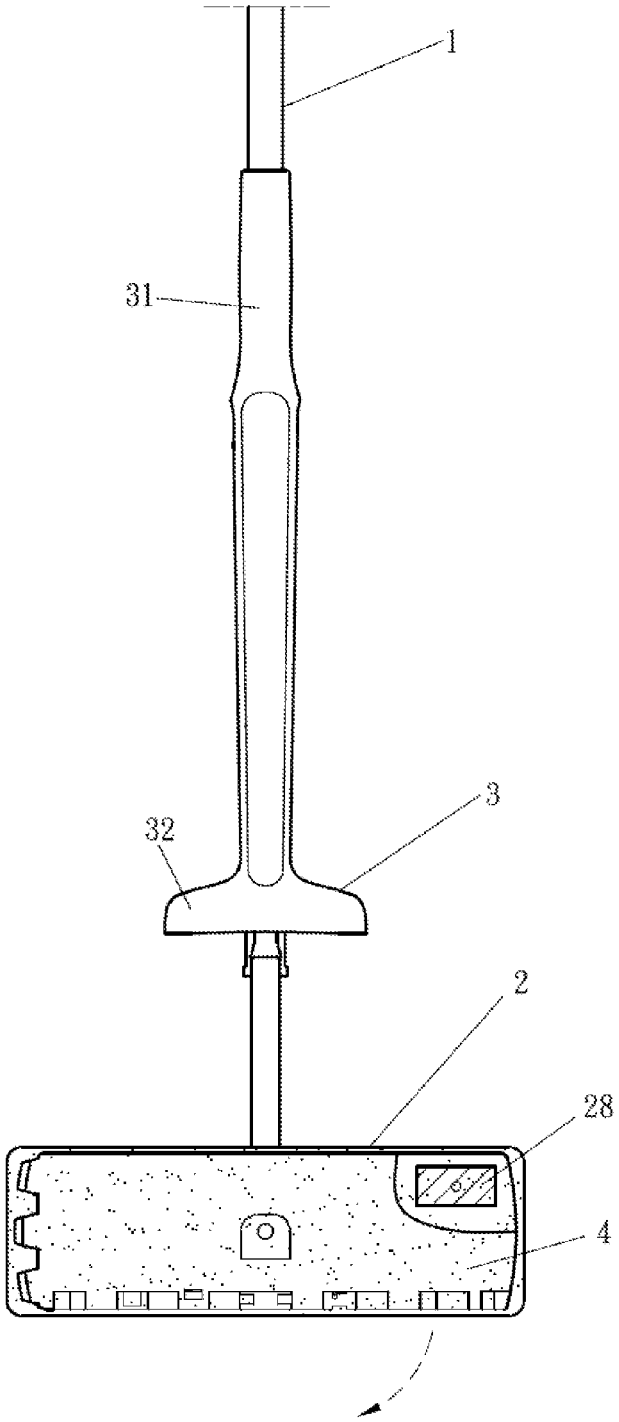
FIG. 8A through FIG. 8E are schematic views illustrating the water squeezing state of the double-sided mop in an embodiment of this invention.
Figure 8B:
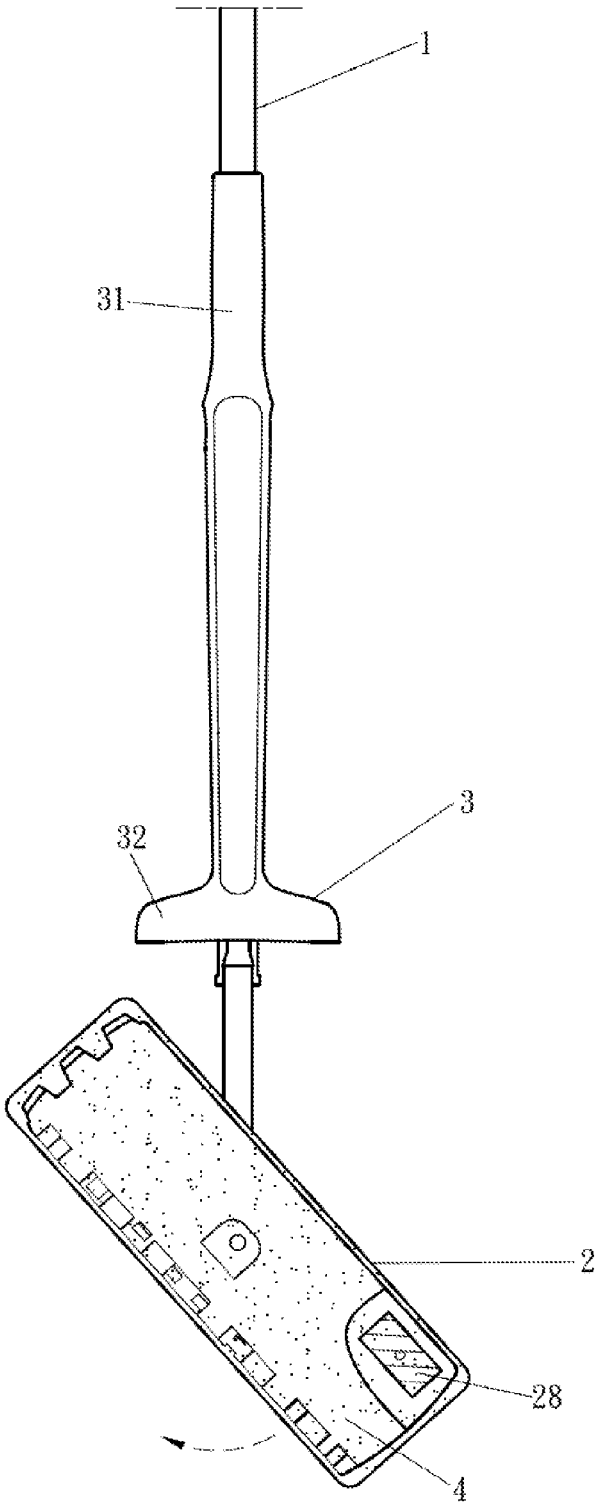
Figure 8C:
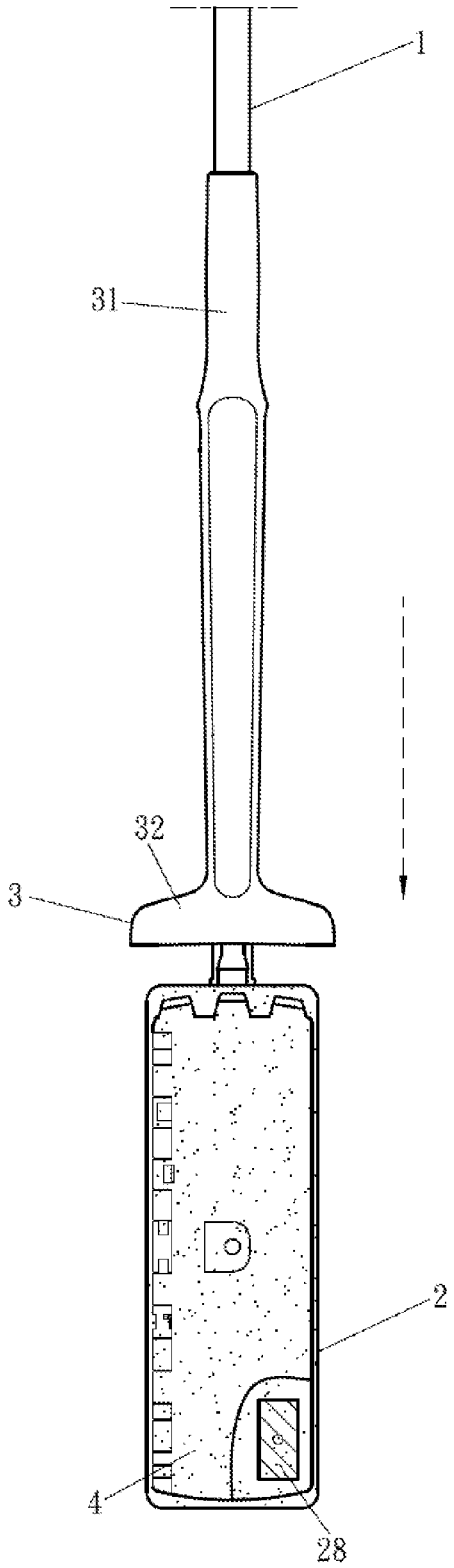
Figure 8D:
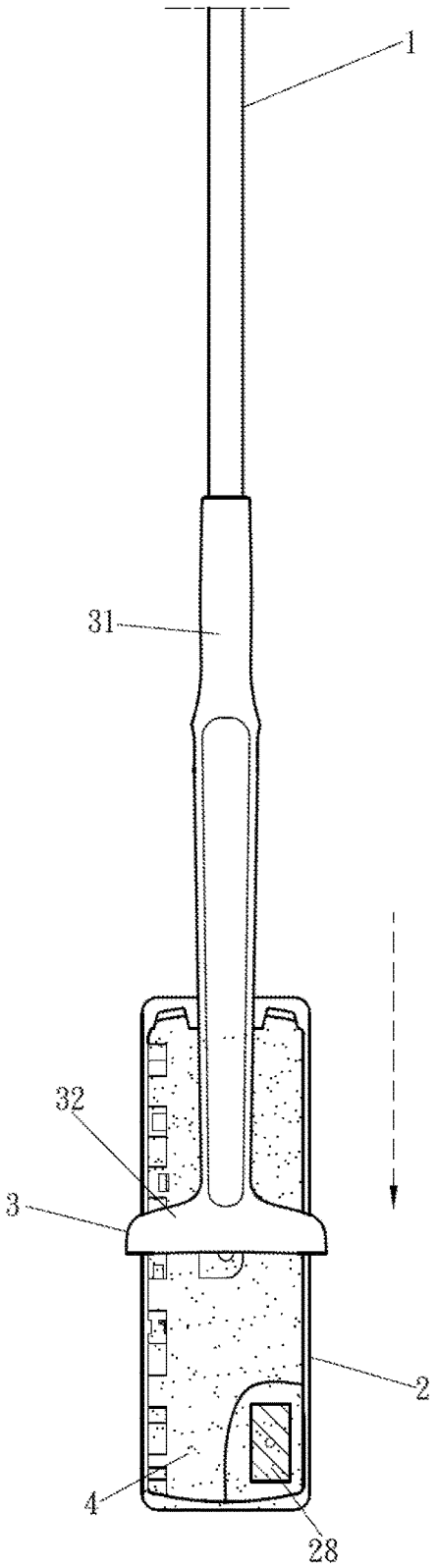
Figure 8E:
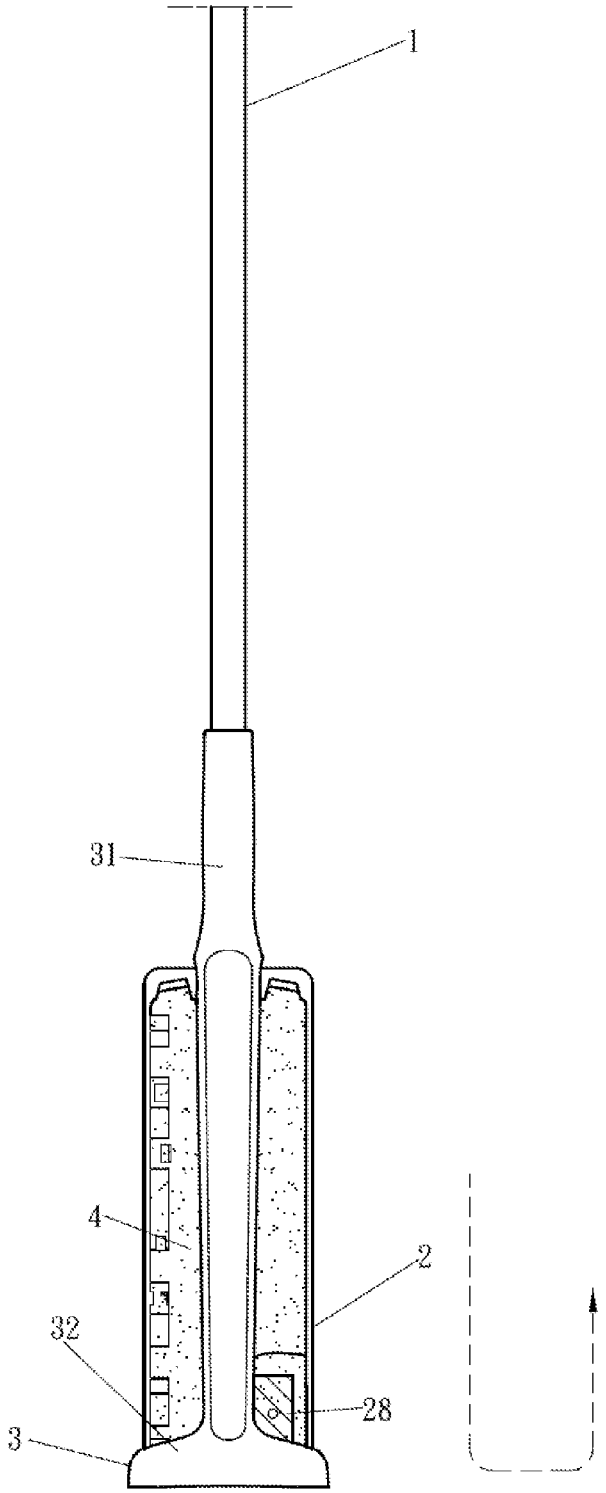

Concretely, the pieces of cleaning cloth 4 according to this invention are provided separately on the first panel 22 and the second panel 23, which is kept away from a side of the mounting plate 21, so as to make the first panel 22 or the second panel 23 to be flat arranged on the floor for cleaning work. When a cleaner wants to use the cleaning cloth 4 provided on the first panel 22 to clean the floor, s/he may arrange the first panel 22 flat on the floor. With a force applied by the cleaner on the mop pole 1, the mounting plate 21 is brought on the first panel 22. With reference to FIG. 7A through FIG. 7C, when the cleaner holds the mop pole 1 to clean, the mop pole 1 freely rotates tangentially around the hinged shaft 24. When the mop pole 1 works, it drives the second panel 23 to rotate and keep away from the first panel 22, thereby making the mop pole 1 vertical with respect to the first panel 22.

In an embodiment, the universal joint 25 comprises a damper 251 hinged onto the mounting plate 21, and a rotation shaft 252 that is provided on the damper 251 and is provided for connection to the mop pole 1. Accordingly, the connecting rod 26 may rotate around the rotation shaft 252. Further, the rotation shaft 252 is vertical to the hinged shaft 24 so that the mop pole 1 may rotate all around with respect to the mop head 2. In this embodiment, this invention has the features of simplified structure, reasonable design, and flexible operation. Further, the rotation shaft 252 in this embodiment is provided roughly in the center of the mop head 2.

In an embodiment, one end of the connecting rod 26 connects to the mop pole 1, while the other end passes through the first panel 22 and the second panel 23 to connect to the universal joint 25. Concretely, the connecting rod 26 connects to the mop pole 1 and a universal joint 25. The connecting rod 26 is hinged and connects to the rotation shaft 252 of the universal joint 25.

In an embodiment, the elastic part is a torsional spring 27. The torsional spring 27 comprises a body 271, a first arm 272 that stretches from the body 271 and is provided on the first panel 22 to apply a force to the first panel 22, and a second arm 273 that stretches from the body 271 and is provided on the second panel 23 to apply a force to the second panel 23. With the torsional spring 27, the first panel 22 and the second panel 23 are made to move toward the mounting plate 21 and tightly clamp the mounting plate 21. During mopping, the mop pole 1 is stressed from front and rear directions, namely moving directions. The first panel 22 and the second panel 23 are brought to the floor by the connecting rod 26 that is working and, on the other hand, flips when the connecting rod 26 moves frontward and backward. When the external force is removed, the first panel 22 and the second panel 23 return to the clamping state when the torsional spring 27 works.

Refer to FIG. 8A through FIG. 8E. In an embodiment, the double-sided mop comprises a water-squeezing frame 3. The water-squeezing frame 3 comprises a sleeve 31 set around the mop pole 1, and a water-squeezing portion 32 fixed onto the sleeve 31. The water-squeezing frame 3 forms a travel movement with respect to the mop pole 1 that glides, and moves the travel movement when a cleaner operate the mop. In the travel movement, the water-squeezing portion 32 glides with respect to the cleaning cloth 4 to squeeze water out of the cleaning cloth 4.

In an embodiment, the double-sided mop further comprises a counterweight block 28 that is fixed onto the mop head 2 and is arranged at a side of a connection where the connecting rod 26 connects to the universal joint 25. With the counterweight block 28, when the double-sided mop is lifted relatively from the floor, the mop head 2 automatically rotates and stops until it aligns with the mop pole 1, thereby facilitating water squeezing from the mop head 2.

In an embodiment, the counterweight block 28 is provided on the mounting plate 21 and kept away from the side of connection where the connecting rod 26 connects to the universal joint 25.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

What is claimed is:

1. A double-sided mop, comprising a mop pole, a mop head connecting to the mop pole, and a cleaning cloth provided on the surface of mop head, and being characterized in that:

the mop head comprises a first panel, a second panel that is corresponding to the first panel, a mounting plate that is clamped between the first panel and the second panel, a hinged shaft connecting to the first panel, the mounting plate, and the second panel, an elastic part connecting to the first panel and the second panel so as to make the first panel and the second panel to be normally folded or unfolded toward the mounting plate, and a universal joint that is provided on the mounting plate and connects to the mop pole and thus may run in a rotation travel so as to make the mop head rotate with respect to the mop pole.

2. The double-sided mop according to claim 1, wherein the universal joint comprises a damper hinged onto the mounting plate, and a rotation shaft that is provided on the clamper and is provided for connection to the mop pole.

3. The double-sided mop according to claim 2, wherein the mop head comprises a connecting rod, one end of the connecting rod connects to the mop pole, and the other end connects to the universal joint which is between the first panel and the second panel.

4. The double-sided mop according to claim 3, wherein the elastic part is a torsional spring and the torsional spring comprises a body, a first arm that stretches from the body and is provided on the first panel to apply a force to the first panel, and a second arm that stretches from the body and is provided on the second panel to apply a force to the second panel.

5. The double-sided mop according to claim 3, wherein the double-sided mop comprises a water-squeezing frame, which comprises a sleeve set around the mop pole, a water-squeezing portion fixed onto the sleeve, the water-squeezing frame formed a travel movement with respect to the mop pole that glides, wherein in the travel movement, the water-squeezing portion glides with respect to the cleaning cloth to squeeze water out of the cleaning cloth.

6. The double-sided mop according to claim 3, wherein the double-sided mop further comprises a counterweight block that is fixed onto the mop head and is arranged at a side of the connection where the connecting rod connects to the universal joint.

7. The double-sided mop according to claim 6, wherein the counterweight block is provided on the mounting plate and spaced from the side of connection where the connecting rod connects to the universal joint.

8. The double-sided mop according to claim 2, wherein the elastic part is a torsional spring and the torsional spring comprises a body, a first arm that stretches from the body and is provided on the first panel to apply a force to the first panel, and a second arm that stretches from the body and is provided on the second panel to apply a force to the second panel.

9. The double-sided mop according to claim 2, wherein the double-sided mop comprises a water-squeezing frame, which comprises a sleeve set around the mop pole, a water-squeezing portion fixed onto the sleeve, the water-squeezing frame formed a travel movement with respect to the mop pole that glides, wherein in the travel movement, the water-squeezing portion glides with respect to the cleaning cloth to squeeze water out of the cleaning cloth.

10. The double-sided mop according to claim 1, wherein the elastic part is a torsional spring and the torsional spring comprises a body, a first arm that stretches from the body and is provided on the first panel to apply a force to the first panel, and a second arm that stretches from the body and is provided on the second panel to apply a force to the second panel.

11. The double-sided mop according to claim 1, wherein the double-sided mop comprises a water-squeezing frame, which comprises a sleeve set around the mop pole, a water-squeezing portion fixed onto the sleeve, the water-squeezing frame formed a travel movement with respect to the mop pole that glides, wherein in the travel movement, the water-squeezing portion glides with respect to the cleaning cloth to squeeze water out of the cleaning cloth.

* * * * *